United States Patent [19]

Sakata et al.

[11] 4,411,042

[45] Oct. 25, 1983

[54] CLEANING DEVICE

[75] Inventors: Toshio Sakata; Takeji Morikawa, both of Toyokawa, Japan

[73] Assignee: Minolta Camera Kabushiki Kaisha, Osaka, Japan

[21] Appl. No.: 332,995

[22] Filed: Dec. 21, 1981

[30] Foreign Application Priority Data

Dec. 25, 1980 [JP] Japan ..... 55-186307

[51] Int. Cl.[3] ..... G03G 21/00

[52] U.S. Cl. ..... 15/256.51; 118/652; 355/15

[58] Field of Search ..... 15/256.51, 256.5; 355/15; 101/169, 425; 198/497, 498, 499; 118/652

[56] References Cited

U.S. PATENT DOCUMENTS 2,329,277 9/1943 Lodding ..... 15/256.51
3,649,992 3/1972 Thettu .
3,868,744 3/1975 Thettu .
3,986,227 10/1976 Fathergill et al. .
4,260,243 4/1981 Dolan et al. ..... 355/15

*Primary Examiner*—Edward L. Roberts
*Attorney, Agent, or Firm*—Wolder, Gross & Yavner

[57] ABSTRACT

A device for removing residual toner and other particulate materials deposited on the peripheral surface of a roller in a toner image fixing unit includes a thin perforated member in pressure engagement with the peripheral surface. The perforations are large enough to permit the passage therethrough of the particulate materials, are arranged so that their longitudinal extensions along the direction of advance of the peripheral surface are at least transversely continuous and the perforation edges opposed to the peripheral surface direction of advance are at an angle to such direction. The perforations may be of different shapes, circular, elliptical, triangular, etc. and a receiving receptacle is positioned below the cleaning device.

10 Claims, 9 Drawing Figures

CLEANING DEVICE

BACKGROUND OF THE INVENTION

The present invention relates generally to improvements in cleaning devices in electrophotgraphic copying machines, electronic printers and similar machines employing a toner for forming copy images and it relates more particularly to an improved cleaning device for removing deposited toner and other residue from a moving surface such as the periphery of a toner fixing roller and the like.

In electrophotographic copying and similar machines wherein an image is formed of a particulate finely divided toner, the toner image is commonly fixed or fused to a substrate by fixing rollers. Some of the toner and frequently other residues are generally deposited on a rotating roller and unless such deposited toner and residue is removed, a deterioration in the quality of the copy and other undesirable results occur. Cleaning devices for removing the deposited toner and residue include a cleaning member which is usually disposed in contact with the surface of the fixing roller. Commonly used as such a cleaning member is a cleaning roller having an outer peripheral surface formed of metal, rubber, felt or the like (as described, for example, in U.S. Pat. No. 3,649,992 and U.S. Pat. No. 3,868,744), or a cleaning blade made of metal, rubber, film or the like (as described, for example, in U.S. Pat. No. 3,986,227).

However, the cleaning members heretofore employed and proposed possess numerous drawbacks and disadvantages.

The former cleaning member, that is, the cleaning roller, must be very frequently cleaned to remove toner therefrom or must be frequently replaced. Further, to achieve an improved cleaning efficiency, the cleaning roller must be rotated in a direction opposite to, or in the same direction as the direction of rotation of the fixing roller, with a difference between the peripheral speeds of the two rollers at the nip thereof. This entails the drawback that a drive transmission must be additionally provided. With the latter cleaning member, that is the cleaning blade, there is the requirement that the blade be held in uniform contact with the fixing roller, so that the blade, when made of metal, causes damage or wear to the fixing roller, particularly so if the roller is covered with an elastic member over its outer periphery. There is the further drawback that agglomerates of toner particles cause damage to the fixing roller at the contact portion.

Besides the above devices, another cleaning device is known in which a cleaning member is wound up by a small amount at a time to always position a clean portion in pressing contact with the fixing roller. This device, however, possesses the drawback of being complex in construction and requiring a large space.

SUMMARY OF THE INVENTION

The main object of the present invention is to provide an improved cleaning device for removing particulate deposits from a moving surface and which is free of the above drawbacks and which, unlike conventional devices, is simple and compact in construction, has a clean cleaning face at all times and is unlikely to cause damage or wear to the moving surface, such as the peripheral face of a fixing roller which is covered with an elastic member.

The above and other objects of the present invention will become apparent from the following description taken in conjunction with the accompanying drawings.

A cleaning device in accordance with the present invention is employed in removing toner from the surface of a moving member and is characterized in including a cleaning member in pressing contact with the surface of the moving member and provided with a plurality of perforations where the cleaning member is in contact with the surface to remove the toner by way of the perforations.

DESCRIPTION OF THE PREFERRED EMBODIMENTS

Figure 1:
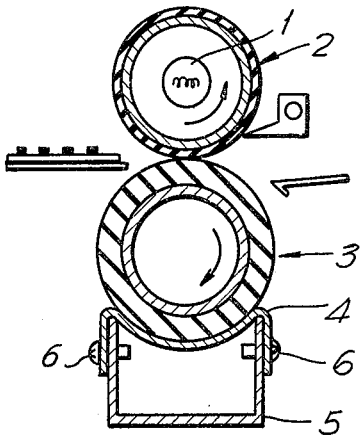
FIG. 1 is a longitudinal sectional view showing a heat roll fixing unit provided with a cleaning device embodying the present invention.
Figure 2:
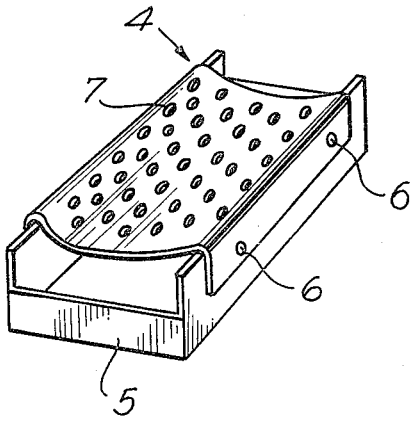
FIG. 2 is a perspective view of the cleaning device of FIG. 1.
Figure 3:
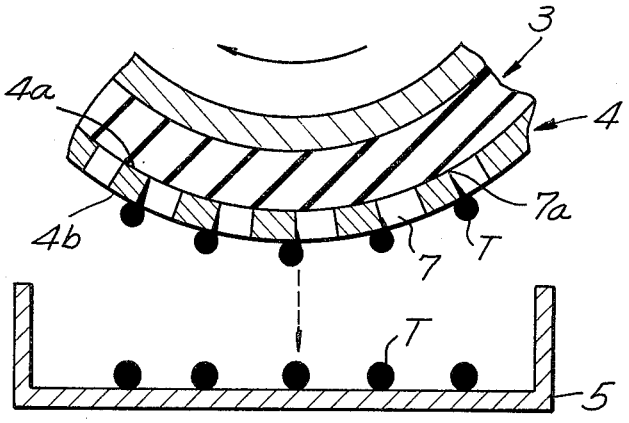
FIG. 3 is an enlarged fragmentary longitudinal sectional view illustrating the cleaning mechanism of the present invention.

Referring now to the drawings, particularly FIGS. 1 to 3 thereof, which illustrate a preferred embodiment of the present invention as applied to a heat roll fixing unit, the fixing unit includes a fixing roller 2 having a heater 1 housed in its interior and a pressure roller 3 having a silicone rubber covering in pressing contact with the fixing roller 2. In accordance with the present invention a cleaning member 4 is secured atop a collecting receptacle 5 by screws 6 and extends along the outer periphery of the rubber covering of pressure roller 3 in pressing contact therewith. As seen in FIG. 2, the cleaning member 4 is formed of a thin metal foil sheet (product of Nitto Kogyo Kabushiki Kaisha, Japan, prepared from nickel by electroforming) having a thickness of 0.1 mm and a large number of circular perforation 7,1.65 mm in diameter. The cleaning member 4 is pressed against the pressure roller 3 over such an area of contact that the perforations 7 on the same circumferential line of the roller 3 are arranged at a spacing of 2.35 mm.

As seen in FIG. 3 which illustrates in detail the pressure roller 3 and the sheet of cleaning member 4 in the area of contact with each other to demonstrate the cleaning mechanism of the present invention, the toner particles T on the silicone rubber surface of the pressure roller 3 (which are transferred thereto from the surface of the fixing roller 1) are scraped off not by the contact face 4*a* of the cleaning member 4 but by the edge portions 7*a* delineating the perforations 7 and opposed to the direction of movement of the pressure roller 3, as illustrated. The toner particles T (including paper particles and other residue deposits) removed by the edge portions 7*a* of the perforations 7 pass through the perforations 7, accumulate on the other side 4*b* of the cleaning member 4 opposite to its contact face 4*a* and are caused to fall into the receptacle 5 for recovery by being subjected, for example, to the vibration resulting from the rotation of the pressure roller 3. When the above described cleaning device was used in the aforesaid fixing unit for making 100,000 copies, no deposition of toner or other matter was found on the cleaning contact face 4a of the cleaning member 4, while the silicone rubber surface of the pressure roller 3 was found to be free of any damage or wear. In contrast, when a conventional device of the type employing a cleaning roller or a cleaning blade was used, marked depositions of toner and other materials were found on the cleaning member after making about 10,000 copies, failing to properly clean the pressure roller in some cases, so that there was the need to clean or replace the cleaning member. Additionally, the cleaning blade caused serious damage and wear to the silicone rubber surface of the pressure roller 3.

Figure 4A:
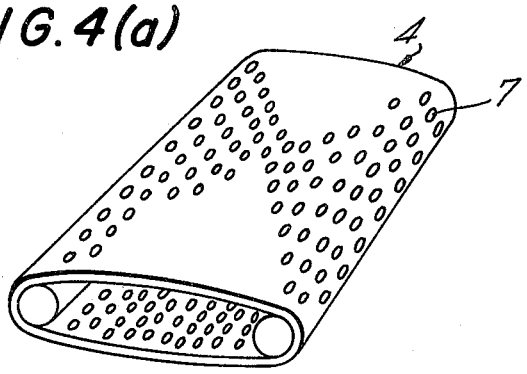
FIGS. 4(*a*) and (*b*) are perspective views showing other embodiments of the invention.
Figure 4B:
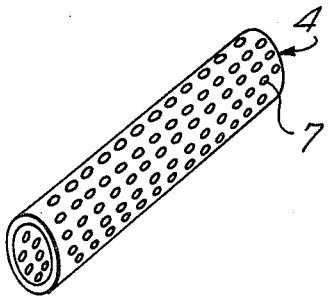
Figure 5A:
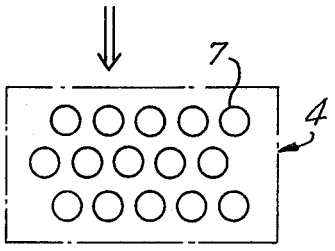
FIGS. 5(*a*) to (*d*) are diagrams showing the sizes, shapes and arrangements of perforations useful for the cleaning device of the invention.
Figure 5B:
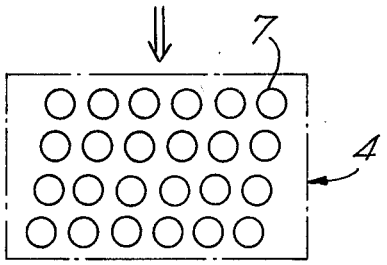
Figure 5C:
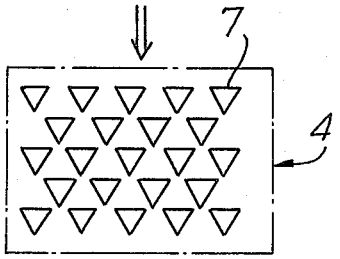
Figure 5D:
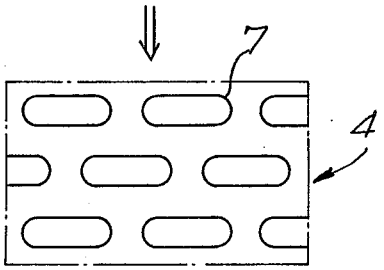

While the cleaning member 4 of the above described embodiment is in the form of a thin sheet, the same result can be achieved with cleaning member 4 in the form of a belt or hollow cylinder as seen in FIG. 4(*a*) or 4(*b*). Although not shown, the cleaing member has a collecting receptacle in its interior. Also useful as materials for the cleaning member 4 are stainless steel (SUS) foil, polyimide film, and the like, which are formed with perforations 7.

The size of the perforations may range from a size (the smallest limit value) that will not permit clogging with paper particles, etc, to a size (the largest limit value) that will not result in an uneven arrangement of the perforations on the outer periphery of the pressure roller. For example, when the pressure roller has an outside diameter of 40 mm, the size of the perforations 7 is preferably in the range of 0.5 mm to 5 mm. However, when the cleaning member is designed to extend along the outer periphery of the pressure roller, the perforations can be larger than 5 mm without entailing any problem.

The perforations may be shaped as desired insofar as at least two perforations are aligned longitudinally of the fixing roller, with at least one perforation positioned on every circumferential line of the roller. FIGS. 5(*a*) to (*d*) show some arrangements of the perforations 7.

FIG. 5(*a*) shows the perforation pattern employed in the embodiment of the present invention shown in FIG. 2. The perforations are arranged in a plurality of rows perpendicular to the direction of advance (rotation) of the pressure roller indicated by an arrow. The perforations 7 are equidistantly spaced apart along the rows and also in the above-mentioned direction. The perforations in odd-numbered rows are positioned intermediately between those in even-numbered rows. The perforations have a diameter larger than the spacing between successive perforations.

FIG. 5(*b*) shows a pattern which is different from that of FIG. 5(*a*) and in which the perforations 7 are arranged in a plurality of rows at a small angle of inclination with respect to the direction of advance of the pressure roller indicated by an arrow.

In the embodiment of FIG. 5(*c*), the perforations 17 are in the same arrangement as the perforations 7 shown in FIG. 5(*a*) except that the perforations are spaced apart by a smaller distance in the direction of advance of the pressure roller than sidewise and are in the form of inverted triangles.

In the embodiment illustrated in FIG. 5(*d*) the perforations 27 are in the same arrangement as the perforations 17 in FIG. 5(*c*) except that the perforations are elliptical with their long axes transverse.

An improved result is achieved by the perforations when the edge portions defining the perforations and opposed to the direction of rotation of the pressure roller are oriented at an angle with respect to the direction of rotation.

While there have been described and illustrated preferred embodiments of the present invention, it is apparent that numerous alterations, omissions and additions may be made without departing from the spirit thereof.

We claim:

1. A cleaning device for removing toner from the surface of a moving member, said cleaning device including a cleaning member in pressing contact with the surface of the moving member and formed with a plurality of perforations in the area where the cleaning member is in contact with said surface to remove the toner by the edge portions defining said perforations.

2. A cleaning device as claimed in claim 1, where said cleaning member is in the form of a sheet.

3. A cleaning device as claimed in claim 1, wherein said cleaning member is in the form of an endless belt.

4. A cleaning device as claimed in claim 1, wherein said cleaning member is in the form of a hollow cylinder.

5. A cleaning device as claimed in any of claims 1 to 4, wherein said plurality of perforations of the cleaning member are aligned at least two perforations longitudinally of the moving member, with at least one perforation positioned on every circumferential band of the moving member.

6. A cleaning device as claimed in claim 5, wherein said edge portions defining the perforations and opposed to the direction of rotation of the moving member are shaped at an angle with respect to the direction of rotation.

7. In combination with a rotatable roller subject to deposits of a finely divided material, means for removing said deposits from the peripheral surface of said roller comprising a cleaning member extending along the width of and in pressing contact with said peripheral surface and having a plurality of longitudinally and transversely spaced perforations in the area where the cleaning member is in contact with said surface and of dimensions greater than the particle size of said timely divided material to remove the finely divided material by the edge portions defining said perforations, the longitudinal extensions of said perforations being at least substantially transversely continuous.

8. The combination of claim 7 wherein said roller constitutes a component of a toner fixing mechanism in an electrophotographic copying machine and said material includes said toner.

9. The combination of claim 8 wherein said cleaning member comprises a thin flexible sheet having said perforations and engaging said peripheral surface.

10. The combination of claim 9 wherein said cleaning member extends longitudinally peripherally along said roller peripheral surface.

* * * * *